US008302247B2

(12) United States Patent
Smith et al.

(10) Patent No.: US 8,302,247 B2
(45) **Date of Patent: *Nov. 6, 2012**

(54) RELEASABLE PAINT ROLLER COVER RETAINER

(75) Inventors: Robin E. Smith, Stanley, NC (US); Natalia Johnson, Statesville, NC (US); Christopher John Parke, Cornelius, NC (US); Brandon Seth Cross, Huntersville, NC (US); George Andrew Hartel, Huntersville, NC (US); Kimberly Clendenen Franklin, Statesville, NC (US)

(73) Assignee: Newell Operating Company, Huntersville, NC (US)

( * ) Notice: Subject to any disclaimer, the term of this patent is extended or adjusted under 35 U.S.C. 154(b) by 1424 days.

This patent is subject to a terminal disclaimer.

(21) Appl. No.: 11/973,530

(22) Filed: Oct. 9, 2007

(65) Prior Publication Data

US 2009/0089952 A1 Apr. 9, 2009

(51) Int. Cl.
*B05C 17/02* (2006.01)

(52) U.S. Cl. ..... 15/230.11; 492/13; 492/19

(58) Field of Classification Search ..... 15/230.11; 492/13, 19

See application file for complete search history.

(56) References Cited

U.S. PATENT DOCUMENTS

| | | | |
|---|---|---|---|
| 1,728,417 | A | 9/1929 | Lewis |
| 1,887,790 | A | 11/1932 | Stogner |
| 2,113,141 | A | 4/1938 | Huenlich et al. |
| 2,197,883 | A | 4/1940 | Sinclair |
| 2,263,439 | A | 11/1941 | Hansen |
| 2,520,863 | A | 8/1950 | Thomas et al. |
| 2,647,276 | A | 8/1953 | Thomas et al. |
| 2,669,743 | A | 2/1954 | Coughlin |
| 2,675,605 | A | 4/1954 | Thomas |
| 2,678,473 | A | 5/1954 | Butler |
| 2,684,497 | A | 7/1954 | Graham |
| 2,891,301 | A | 6/1959 | Conklin |
| 2,935,757 | A | 5/1960 | Phillips |
| 2,970,366 | A | 2/1961 | Gill |
| 2,977,671 | A | 4/1961 | Wiegand |
| 2,982,010 | A | 5/1961 | Johns |
| 2,987,746 | A | 6/1961 | Davis et al. |
| 3,060,555 | A | 10/1962 | Kirshenbaum et al. |
| 3,335,446 | A | 8/1967 | McGinley |
| 3,447,184 | A | 6/1969 | McGinley |
| 3,638,271 | A | 2/1972 | Pharris et al. |
| 3,711,887 | A | 1/1973 | Chapman |
| 3,745,624 | A | 7/1973 | Newman |
| 3,751,748 | A | 8/1973 | Roe et al. |
| 3,774,278 | A | 11/1973 | Ashton |

(Continued)

FOREIGN PATENT DOCUMENTS

| | | | |
|---|---|---|---|
| EP | 1 604 745 | A | 12/2005 |

(Continued)

*Primary Examiner* — Randall Chin

(74) *Attorney, Agent, or Firm* — Baker & Hostetler LLP

(57) ABSTRACT

A paint roller including a roller cover retainer that is releasable to permit a roller cover to be easily removed. The device includes a locking lever pivotable relative to the frame which actuates retainers located within the roller assembly. The locking lever also exerts an axial force adapted to disengage the roller cover from the roller assembly when the retainer is disengaged. A used roller cover can be removed without the need to grasp the used roller cover. Installation of a roller cover onto the roller assembly automatically engages the retainers and shifts the locking lever into the locked position.

18 Claims, 11 Drawing Sheets

U.S. PATENT DOCUMENTS

| | | | |
|---|---|---|---|
| 3,832,749 | A | 9/1974 | Hawk |
| 3,877,123 | A | 4/1975 | Pharris |
| 3,986,226 | A | 10/1976 | Roe et al. |
| 4,209,883 | A | 7/1980 | Hawk |
| 4,316,301 | A | 2/1982 | Smith et al. |
| 4,361,923 | A | 12/1982 | McKay |
| 4,402,102 | A | 9/1983 | Al-Samman |
| 4,615,634 | A | 10/1986 | Matsuda |
| 4,717,276 | A | 1/1988 | O'Brien et al. |
| 4,897,893 | A | 2/1990 | Barker |
| 4,937,909 | A | 7/1990 | Georgiou |
| 4,985,959 | A | 1/1991 | Lieberman et al. |
| 5,210,899 | A | 5/1993 | Goldstein et al. |
| 5,345,648 | A | 9/1994 | Graves |
| 5,490,303 | A | 2/1996 | Graves |
| 5,619,769 | A | 4/1997 | Hutt |
| 5,806,131 | A | 9/1998 | Tennant |
| 5,870,795 | A | 2/1999 | Sizemore |
| 5,903,952 | A | 5/1999 | Camp, Jr. et al. |
| 5,979,009 | A | 11/1999 | Polzin et al. |
| 5,987,692 | A | 11/1999 | Sizemore |
| 6,012,473 | A | 1/2000 | Koyama |
| 6,066,053 | A | 5/2000 | Sehemberger |
| 6,101,662 | A | 8/2000 | Polzin et al. |
| 6,102,382 | A | 8/2000 | Labesky |
| 6,182,322 | B1 | 2/2001 | Tubman |
| 6,367,114 | B1 | 4/2002 | Babkowski |
| 6,378,158 | B1 | 4/2002 | Bukovitz |
| 6,405,404 | B2 | 6/2002 | Babkowski |
| 6,438,788 | B1 | 8/2002 | Gartner |
| 6,473,931 | B2 | 11/2002 | Chang |
| 6,510,579 | B1 | 1/2003 | Gartner |
| 6,729,038 | B2 | 5/2004 | Lonier |
| 6,851,155 | B2 | 2/2005 | Dove |
| 6,928,689 | B2 | 8/2005 | Dove |
| 7,028,365 | B2 | 4/2006 | Martin et al. |
| 7,120,963 | B2 | 10/2006 | Kim |
| 7,657,959 | B2 * | 2/2010 | Smith et al. ..... 15/230.11 |
| 2004/0205921 | A1 | 10/2004 | Woodruff et al. |
| 2006/0130261 | A1 | 6/2006 | Futo et al. |
| 2007/0256268 | A1 | 11/2007 | Mertins, Jr. |

FOREIGN PATENT DOCUMENTS

| | | | |
|---|---|---|---|
| GB | 2 399 522 | A | 9/2004 |
| GB | 2 443 919 | A | 5/2008 |
| WO | WO 00/37184 | | 6/2000 |
| WO | WO 2008-053195 | | 5/2008 |

* cited by examiner

RELEASABLE PAINT ROLLER COVER RETAINER

BACKGROUND OF THE INVENTION

The present invention relates to a roller assembly for use in applying a coating to a surface, and, more particularly, to a paint roller frame and roller support assembly that allows easy installation of a roller cover onto the roller support, securely retains the roller cover on the roller support during painting, and permits convenient and minimally messy removal of the roller cover from the roller support following use.

Paint rollers with removable covers are well known. Normally a roller cover is installed on a roller support such that the roller cover can be removed from the roller support and cleaned or discarded after use. Paint rollers with mechanisms designed to releasably retain a roller cover on the roller support are known. See, for example, U.S. Pat. Nos. 5,345,648 and 5,490,303 to Graves. Roller frames and support assemblies of this type utilize a plurality of small, flexible metal fingers that are deflected radially inward as a roller cover is installed. The metal fingers press outward against the inner surface of the roller cover, thus holding the cover in place during use. The roller cover is removed from the support assembly by grasping it and pulling it axially off of the support assembly. Alternatively, the roller cover may be removed from the support assembly by striking roller frame on a solid object, causing the roller cover to slide off of the support assembly. Both of these methods for removing the roller cover are undesirable because they are potentially messy for the user. U.S. Pat. No. 7,028,365 discloses a similar paint roller which utilizes the same undesirable methods for removing the roller cover.

Other known roller cover retention devices include spring-biased tabs that are manually retracted by depressing a button on the roller handle. These designs are significantly disadvantageous because the tabs must be retracted prior to installing a roller cover. Some consumers find this counterintuitive and their attempts to install a roller cover without properly retracting the tabs may result in dissatisfaction with or damage to the device. Additionally, the button mechanism may require the user to apply a substantial amount of force to overcome the biasing force of the springs which extend the tabs. This makes the device less consumer-friendly, particularly for those with smaller hands or limited grip strength. Some roller cover retention devices incorporating flexible fingers suffer from similar disadvantages. See, e.g., U.S. Pat. No. 3,060,555 disclosing a roller cover retention device including flexible fingers that requires the user to move and hold a metal lever to overcome a biasing spring force to permit installation or removal of a roller cover.

All of the previously described paint rollers are designed to accommodate standard paint roller covers, meaning that many manufacturers produce roller frames and roller covers to the same general specifications such that the frames and covers are generally interchangeable among manufacturers. Other devices utilize non-standard paint roller covers. See, e.g., U.S. Patent Application Publication No. 2006/0130261. These devices are inherently disadvantageous because they do not permit the use of widely-available and inexpensive standard roller covers.

Based on the foregoing, it would be desirable to provide a paint roller assembly using standard roller covers that allows easy installation of the roller cover, securely retains the roller cover during painting, and permits convenient and minimally messy removal of the roller cover following use.

BRIEF SUMMARY OF THE INVENTION

According to the present invention, a paint roller having improved features is provided.

In a first aspect, the present invention paint roller may include a frame having an elongated portion with a terminal end and a contiguous end; a roller assembly rotatably coupled to the elongated portion of the frame and adapted to receive a removable paint roller cover, the roller assembly including an axially movable portion and a fixed portion with fingers extending generally parallel to the elongated portion of the frame. The fingers may slidably engage the axially movable portion such that axial motion of the axially movable portion causes the fingers move radially relative to the elongated roller portion of the frame and the fingers may be contiguous with the fixed portion of the roller assembly. An elastic member may extend around the fingers and hold the fingers in sliding engagement with the axially movable portion.

In an embodiment of the first aspect, the present invention paint roller may further include a locking lever pivotably coupled to the frame and adapted to cause axial movement of the movable portion of the roller assembly when the locking lever is pivoted relative to the frame. Pivoting the locking lever to a locked position may cause the fingers to move radially away from the elongated portion of the frame and pivoting the locking lever to a released position may cause the fingers to move radially towards the elongated portion of the frame. Motion of the locking lever from the locked position to the released position may cause the axially movable portion to move toward the terminal end and motion of the locking lever from the released position to the locked position may cause the axially movable portion to move toward the contiguous end. The thickness of the fingers may vary along the length of each finger, the thickness increasing as a distance from the terminal increases. The axially movable portion may include a flange adapted to push the roller cover at least partially off of the roller assembly when the locking lever is moved from the locked position to the released position. The roller cover may exert a force on the flange generally parallel to the elongated portion of the frame and generally in the direction of the contiguous end as the roller cover is being installed, thus causing the locking lever to pivot from the released position to the locked position. The elastic member may be composed of rubber and may be an o-ring.

In a second aspect, the present invention paint roller may include a frame having an elongated portion with a terminal end and a contiguous end and a roller assembly rotatably coupled to the elongated portion of the frame and adapted to receive a removable paint roller cover. The roller assembly may include an axially movable portion, a fixed portion including fingers which may extend generally parallel to the elongated portion of the frame, and an o-ring extending around the fingers and holding the fingers in sliding engagement with the axially movable portion. The fingers may slidably engage the axially movable portion such that axial motion of the axially movable portion causes the fingers move radially relative to the elongated roller portion of the frame and the fingers may be contiguous with the fixed portion of the roller assembly.

In an embodiment of the second aspect, the present invention paint roller may further include a locking lever pivotably coupled to the frame and adapted to cause axial movement of the movable portion of the roller assembly when the locking lever is pivoted relative to the frame. The axially movable portion may include a flange adapted to push the roller cover at least partially off of the roller assembly when the locking lever is moved from a locked position to a released position.

The roller cover may exert a force on the flange generally parallel to the elongated portion of the frame and generally in the direction of the contiguous end as the roller cover is being installed, thus causing the locking lever to pivot from the released position to the locked position. Pivoting the locking lever to the locked position may cause the fingers to move radially away from the elongated portion of the frame and pivoting the locking lever to the released position may cause the fingers to move radially towards the elongated portion of the frame. Motion of the locking lever from the locked position to the released position may cause the axially movable portion to move toward the terminal end and motion of the locking lever from the released position to the locked position may cause the axially movable portion to move toward the contiguous end. The thickness of the fingers may vary along the length of each finger, the thickness increasing as a distance from the terminal end increases.

In a third aspect, the present invention paint roller may include a frame having an elongated portion adapted to releasably couple with a removable paint roller cover having an integral bearing and having a terminal end and a contiguous end; a sliding block slidably coupled with the elongated portion of the frame and adapted to push the roller cover off of the elongated portion of the frame; and a locking lever pivotably affixed to the sliding block. The locking lever may be pivotable between a locked position and an unlocked position, the locked position being such that the sliding block is rigidly retained at the contiguous end of the elongated portion of the frame and the unlocked position permitting movement of the sliding block along the elongated portion of the frame, thus allowing the roller cover to be pushed off of the elongated portion of the frame. The sliding block may be slidable along substantially all of the elongated portion of the frame when the locking lever is in the unlocked position. The locking lever may prevent the sliding block from sliding beyond the terminal end of the elongated portion of the frame.

In a fourth aspect, the present invention paint roller may include a frame having an elongated portion with a terminal end and a contiguous end; and a roller assembly rotatably coupled to the elongated portion of the frame and adapted to receive a removable paint roller cover including an axially movable portion, and a fixed portion. The fixed portion may include a plurality of fingers slidably engaging the axially movable portion such that axial motion of the axially movable portion in a first direction may cause the fingers to elastically deform radially away from the elongated portion of the frame and axial motion of the axially movable portion in a second direction, the second direction being opposite the first direction, allows the fingers to return to a less elastically-deformed position thereby moving radially towards the elongated portion. The paint roller may include a locking lever pivotably coupled to the frame and adapted to cause axial movement of the axially movable portion of the roller assembly when the locking lever is pivoted relative to the frame. The axially movable portion may include a flange adapted to push the roller cover at least partially off of the roller assembly when the locking lever is moved from a locked position to a released position.

Other features and advantages of the present invention will become apparent to those skilled in the art upon consideration of the following detailed description of preferred embodiments exemplifying the best mode of carrying out the invention as presently perceived. The drawings are only to serve for reference and illustrative purposes, and are not intended to limit the scope of the invention.

BRIEF DESCRIPTION OF THE SEVERAL VIEWS OF THE DRAWINGS

The detailed description particularly refers to the accompanying Figures in which.

DETAILED DESCRIPTION OF THE INVENTION

Figure 1:
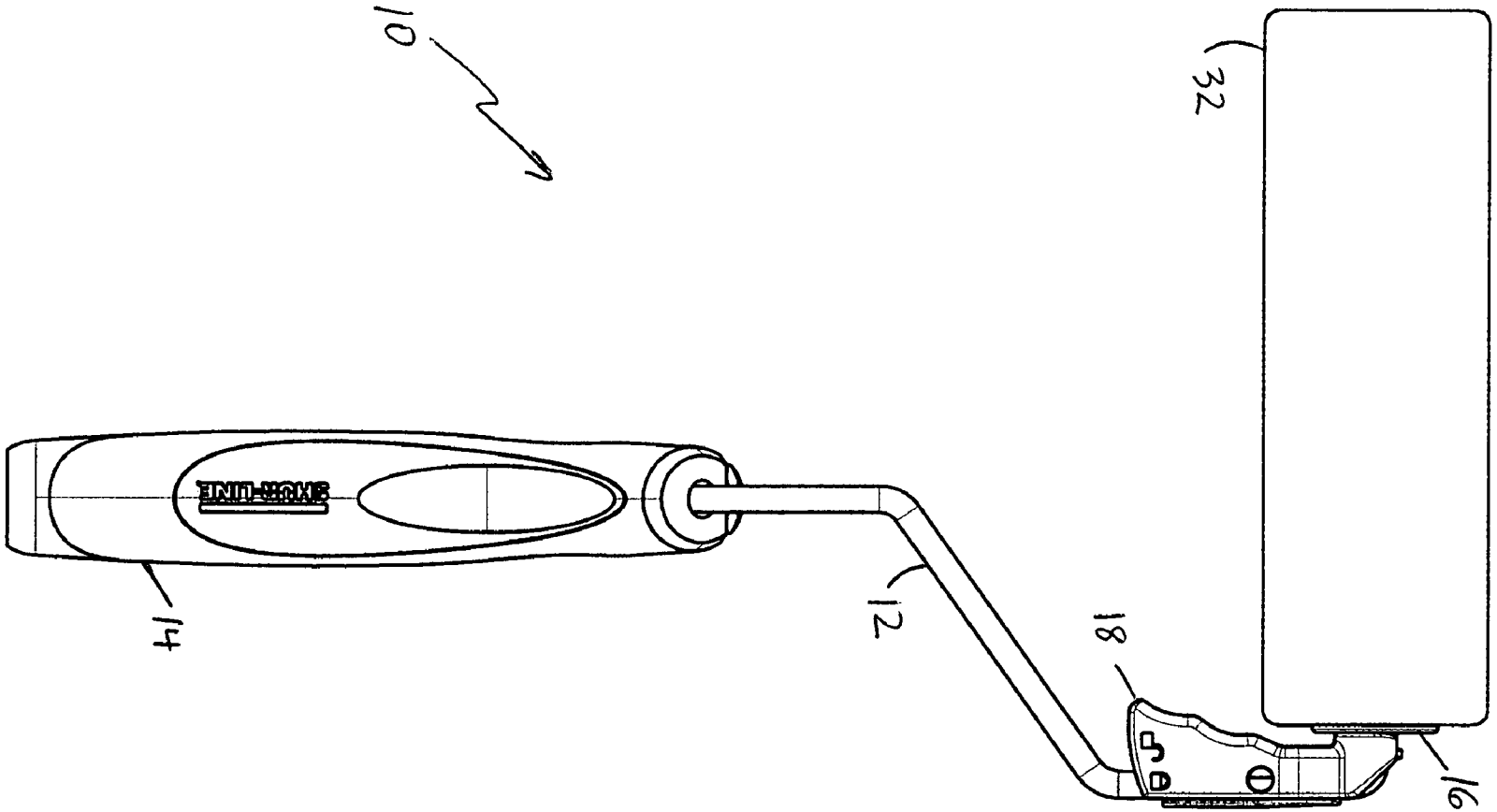
FIG. 1 is a front view of an exemplary embodiment of a paint roller according to the present invention.

As shown in the appended drawings described above, the present invention is comprised of a paint roller 10. As depicted in FIG. 1, paint roller 10 preferably includes a frame 12 to which a handle 14 and a roller assembly 16 are attached. In this view, a roller cover 32 is installed on roller assembly 16. The paint roller 10 also includes an locking lever 18 that is pivotally attached to the frame 12.

The frame 12 is preferably made from heavy gauge wire or metal rod. In alternative embodiments, the frame may be made from other suitable materials including plastic or fiberglass. The handle 14 is preferably molded of plastic. Additionally, the handle 14 may be hollow and may include a threaded hole 39 adapted to couple with the end of an extension rod (see FIG. 3). Alternatively, other hand grips known in the art may be used without departing from the scope of the invention.

Figure 2:
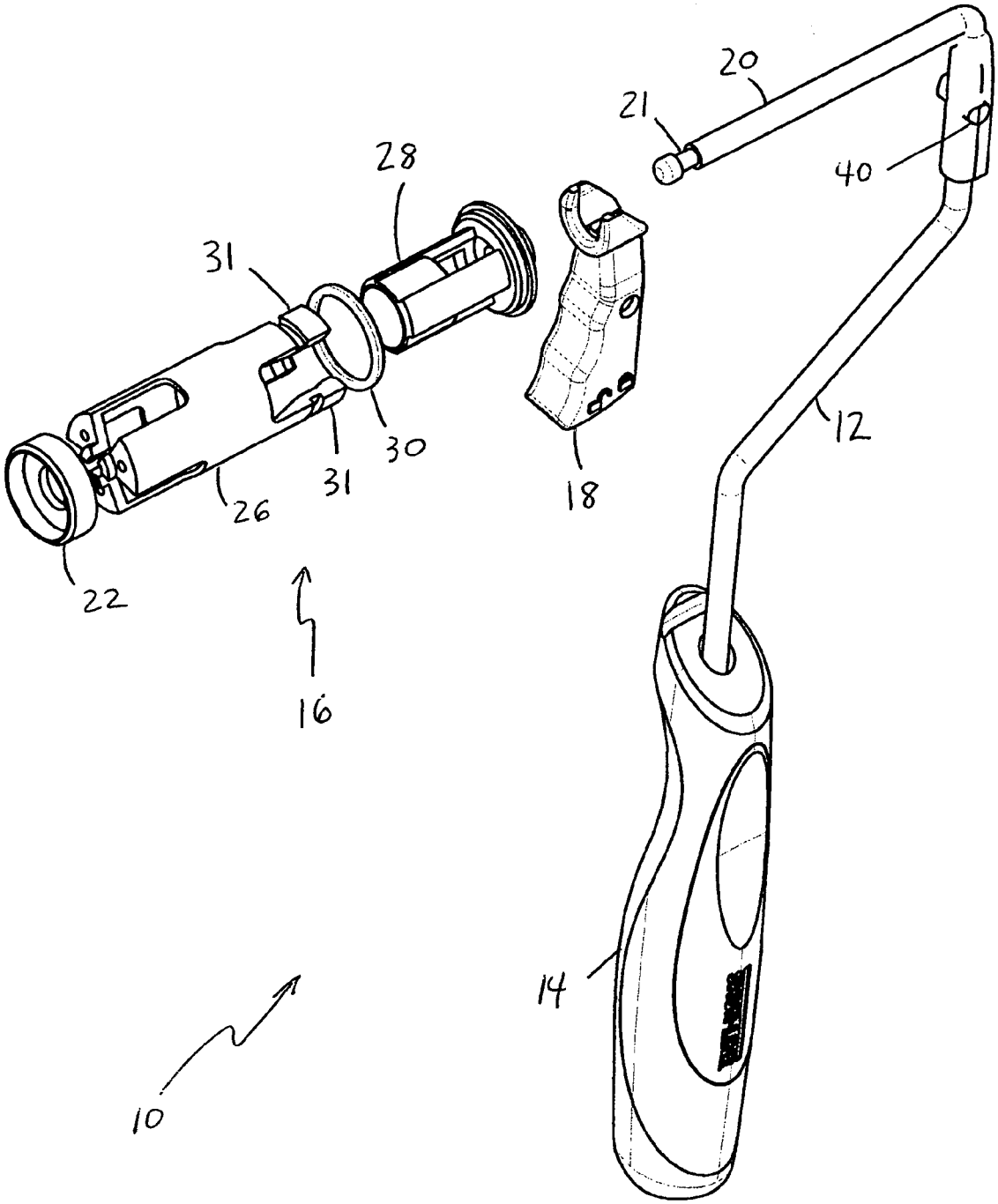
FIG. 2 is a front isometric exploded view of an exemplary embodiment of a paint roller in accordance with the present invention.

As depicted in FIG. 2, the frame 12 includes a roller shaft 20 about which the roller assembly 16 freely rotates. The frame 12 preferably includes a groove 21 near the end of shaft 20. The roller assembly 16 includes tabs 17 that couple with groove 21, thus preventing axial movement of the roller assembly 16 (see FIG. 4). In alternative embodiments, the roller assembly 16 may couple with the frame 12 using other means such as, but not limited to, a retaining ring instead of tabs 17, the end of frame 12 may be swaged to retain the roller assembly 16, or the end of frame 12 may be drilled and tapped to permit the use of a shoulder screw to retain roller assembly 16 on frame 12.

The roller assembly 16 includes an end cap 22, a fixed hub 26, a sliding hub 28, and an o-ring 30. The components of the roller assembly 16 are preferably composed of molded plastic, with the exception of the o-ring 30 which is preferably composed of an elastic material such as rubber. When assembled, the o-ring 30 is supported by the fingers 31 of the fixed hub 26. The sliding hub 28 is slidable axially along the shaft 20. The locking lever 18 is pivotable about pivot point 40.

Figure 3:
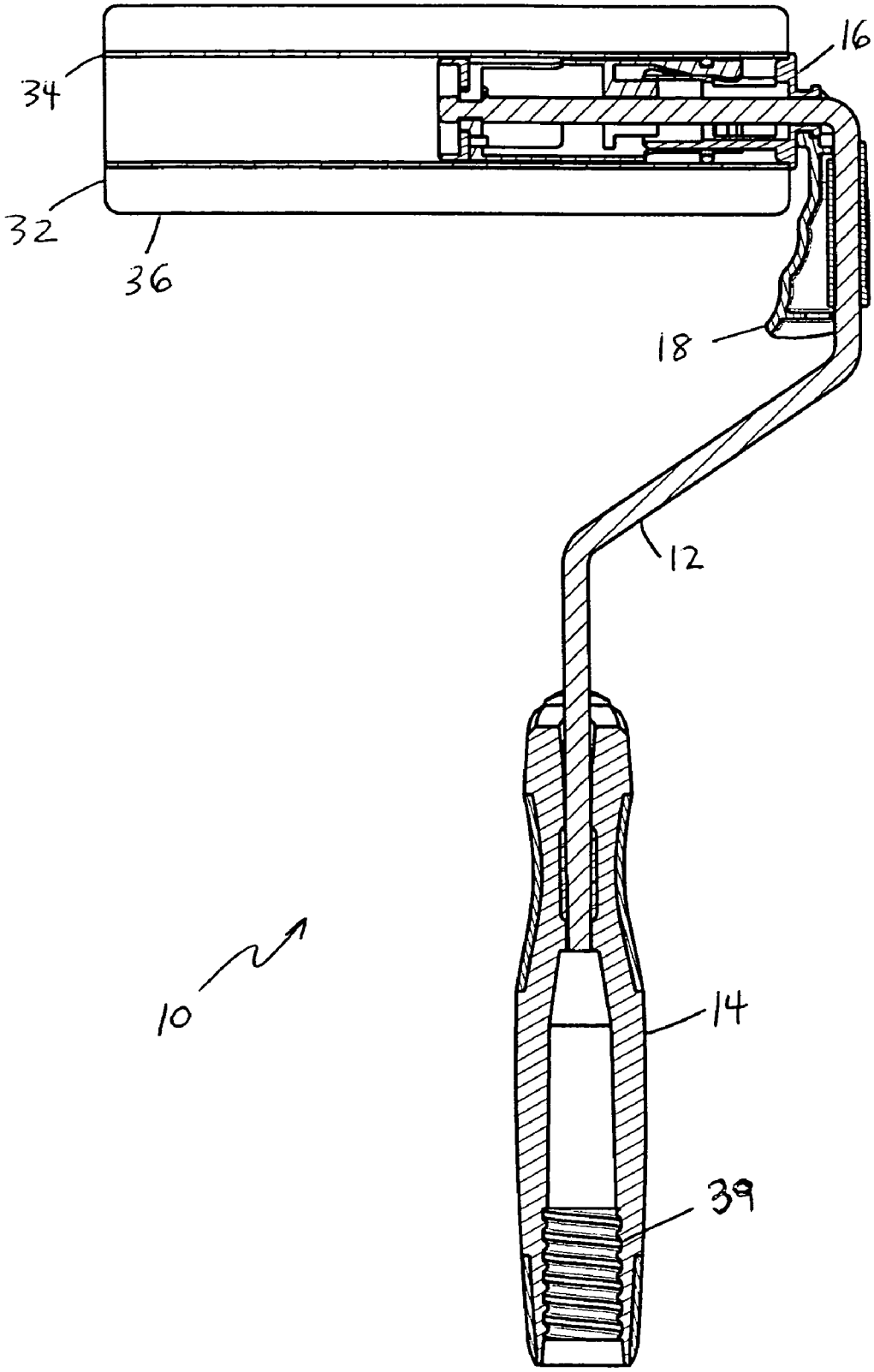
FIG. 3 is front section view of an exemplary embodiment of a paint roller in accordance with the present invention.

As shown in FIG. 3, the roller assembly 16 is adapted to accept a roller cover 32. The roller cover 32 is preferably a "mini" removable paint roller cover as is known in the art, meaning that it is narrower in diameter than standard 1.5" (3.81 cm) diameter roller covers. In the first exemplary embodiment the roller cover is 1" (2.54 cm) in diameter. The roller cover includes a rigid tubular portion 34 around which a nap portion 36 is affixed. The outer diameter of the roller assembly 16 is slightly less than the inner diameter of the rigid tube 34 of the roller cover 32, thus permitting the roller cover 32 to easily slide over the roller assembly 16 except when the o-ring 30 is expanded to engage the rigid tube 34 as described below.

Figure 4:
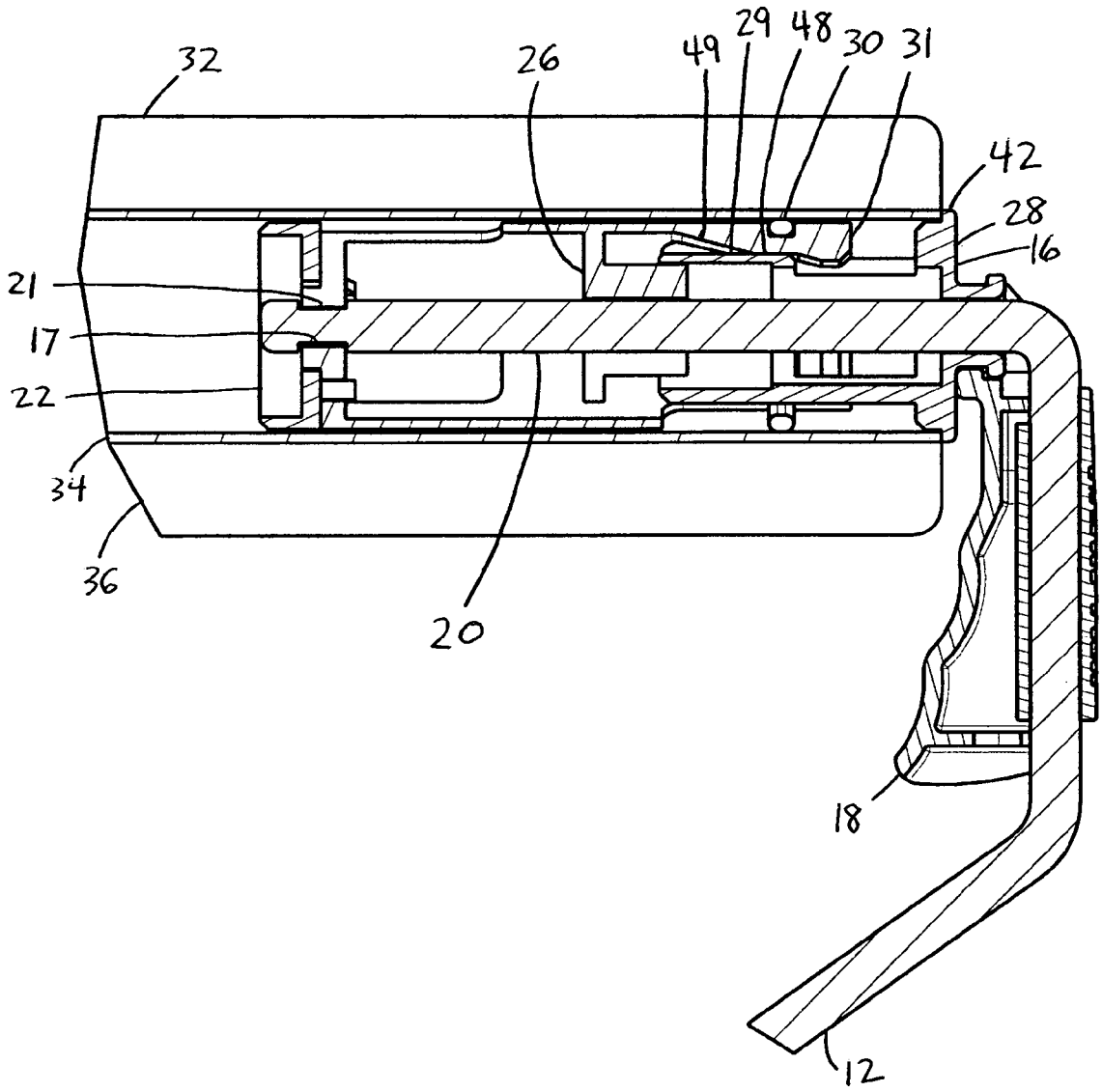
FIG. 4 is a detailed section view of an exemplary embodiment of a paint roller in accordance with the present invention with the locking lever in the locked position.

FIG. 4 shows a detailed section view of a portion of the roller assembly 16 with a roller covered 32 mounted thereon. The locking lever 18 is in the locked position and the fingers 31 are in the expanded position. Because the o-ring 30 is pressed outward into contact with the rigid tube 34 of the roller cover 32, the roller cover 32 is not freely movable relative to the roller assembly 16. The roller assembly 16 remains rotatable relative to the shaft 20.

Figure 5:
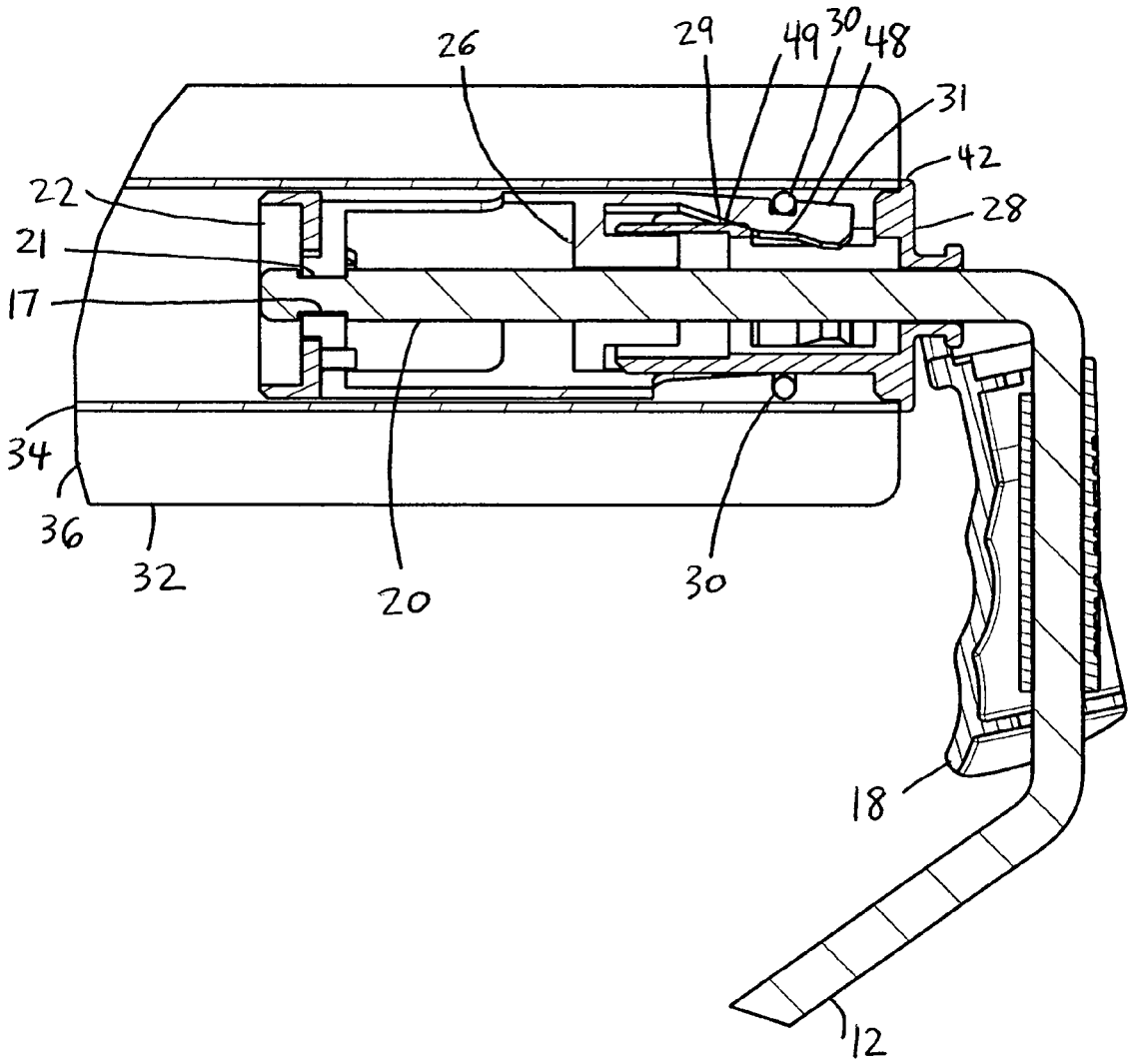
FIG. 5 is a detailed section view of an exemplary embodiment of a paint roller in accordance with the present invention with the locking lever in the released position.

FIG. 5 shows a detailed section view of the same portion of the roller assembly 16 as is depicted in FIG. 4, however the locking lever 18 is in the unlocked position. Notably, the fingers 31 are retracted radially inward towards the shaft 20 and the o-ring 30 is not in contact with the rigid tube 34 of the roller cover 32. In this position the o-ring 30 does not restrict the axial movement of the roller cover 32 relative to the roller assembly 16.

The exemplary embodiment of the paint roller 10 is operated as follows. Starting without a roller cover 32 installed, the user places the locking lever 18 in the released (unlocked) position as is depicted in FIG. 5. This causes the sliding hub 28 to slide axially along the shaft towards the end cap 22. As the sliding hub 28 moves towards the end cap 22, surface 29 of the sliding hub 28 slides along the fingers 31 from contact portion 48 to contact portion 49. Because the fingers 31 are thicker at contact portion 48 than at contact portion 49, the fingers 31 are retracted radially by the o-ring 30 as the sliding hub moves axially towards the end cap 22. With the locking lever 18 in the unlocked position, the fingers 31 are retracted sufficiently for the o-ring 30 to be completely within the inner diameter of the rigid tube 34 of the roller cover 32 to be installed.

The user then inserts the roller assembly 16 into the rigid tube 34 of a roller cover 32. Because the fingers 31 and o-ring 30 remain retracted, the roller cover 32 slides freely until it contacts flange 42 of sliding hub 28. Once the roller cover 32 contacts the flange 42, the user continues to insert the roller assembly 16 into the roller cover 32. This causes the roller cover 32 to push on the sliding hub 28 in the axial direction away from the end cap 22. The movement of the sliding hub 28 away from the end cap 22 has two effects. First, surface 29 of the axially movable portion slides from contact portion 49 to contact portion 48. As a result, fingers 31 move radially outward and the o-ring 30 frictionally engages the rigid tube 34 of the roller cover 32. Second, the movement of the sliding hub 28 away from end cap 22 causes the sliding hub 28 to rotate locking lever 18 into the locked position as shown in FIG. 4.

With the o-ring 30 engaging the roller cover 32 and the locking lever 18 in the locked position, the roller cover 32 is firmly attached to the roller assembly 16. The user may use the paint roller 10 as desired. Of note, although the device is conventionally referred to as a paint roller, it is well understood in the art that paint rollers may be used to apply a wide variety of coatings in addition to paint.

When the user has finished using the paint roller 10 or wishes to replace the roller cover 32, the user holds the paint roller 10 such that the end cap 22 points towards the floor. The user preferably holds the paint roller over a trash can, bucket, or other receptacle appropriate for receiving a used roller cover 32 that is wet with paint. The user then moves locking lever 18 from the locked position to the released position, thus rotating the locking lever about pivot point 40. This causes the locking lever 18 to push the sliding hub 28 axially along the shaft towards end cap 22.

The axial movement of the sliding hub 28 along the shaft 20 towards the end cap 22 has two effects. First, surfaces 29 slide along the fingers 31 from contact portions 48 to contact portions 49, thus allowing the o-ring 30 to retract the fingers 31. Once the o-ring 30 is disengaged from the rigid tube 34 of the roller cover 32, the roller cover 32 can freely slide axially along the roller assembly 16.

Second, flange 42 on sliding hub 28 pushes on rigid tube 34 of the roller cover 32. This causes the roller cover 32 to slide partially off of roller assembly 16. This partial disengagement should be sufficient to free the roller cover 32 from adhering to the roller assembly due to paint accumulated paint.

Although FIGS. 1-5 depict a 1" (2.54 cm) diameter roller cover, it is within the scope of the invention to utilize the locking mechanism of the exemplary embodiment on other sizes of rollers. See, e.g., FIG. 6-8 depicting a 0.5" (1.27 cm) diameter roller cover.

Figure 6:
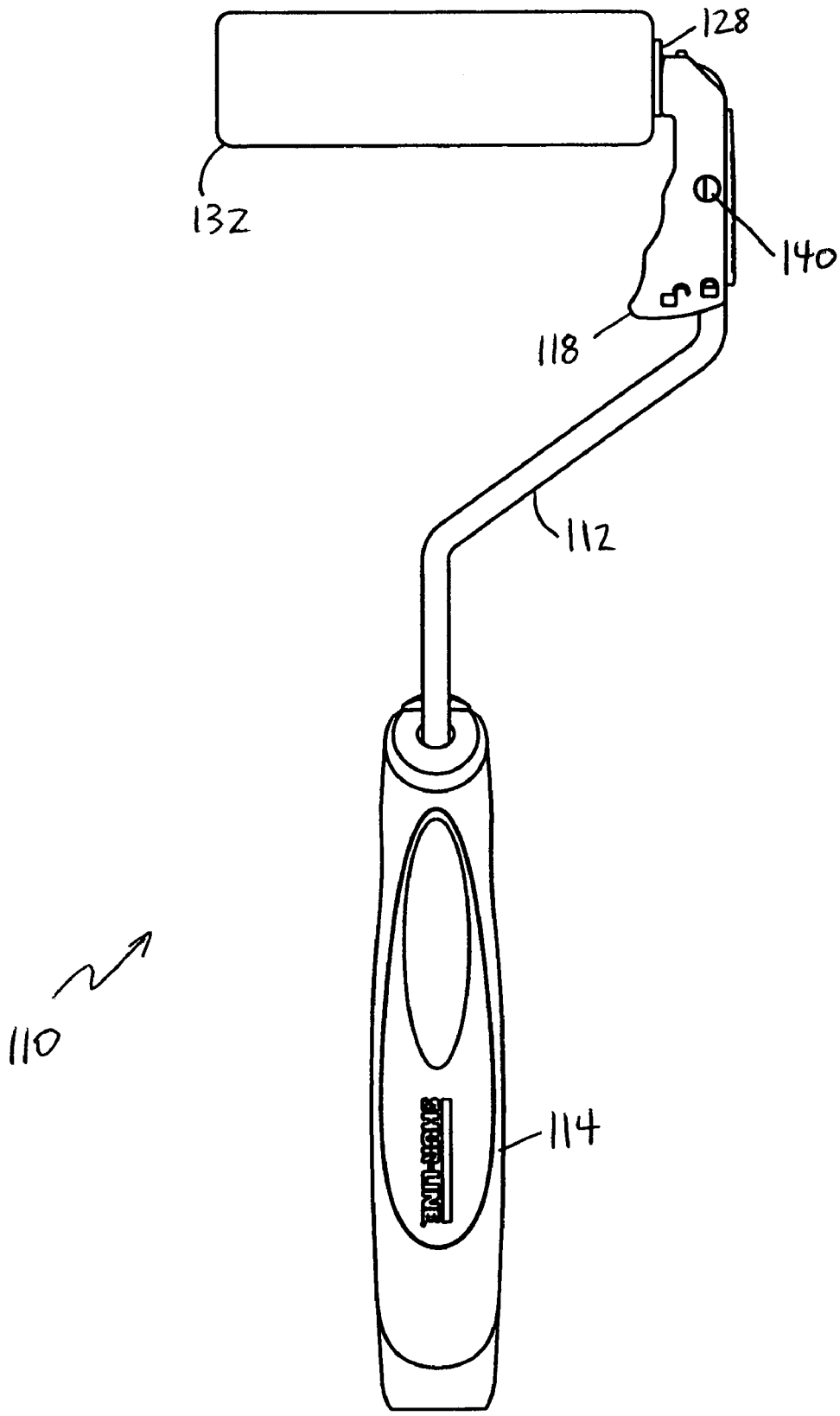
FIG. 6 is front view of an exemplary embodiment of a paint roller including a narrow-diameter roller cover according to the present invention.
Figure 7:
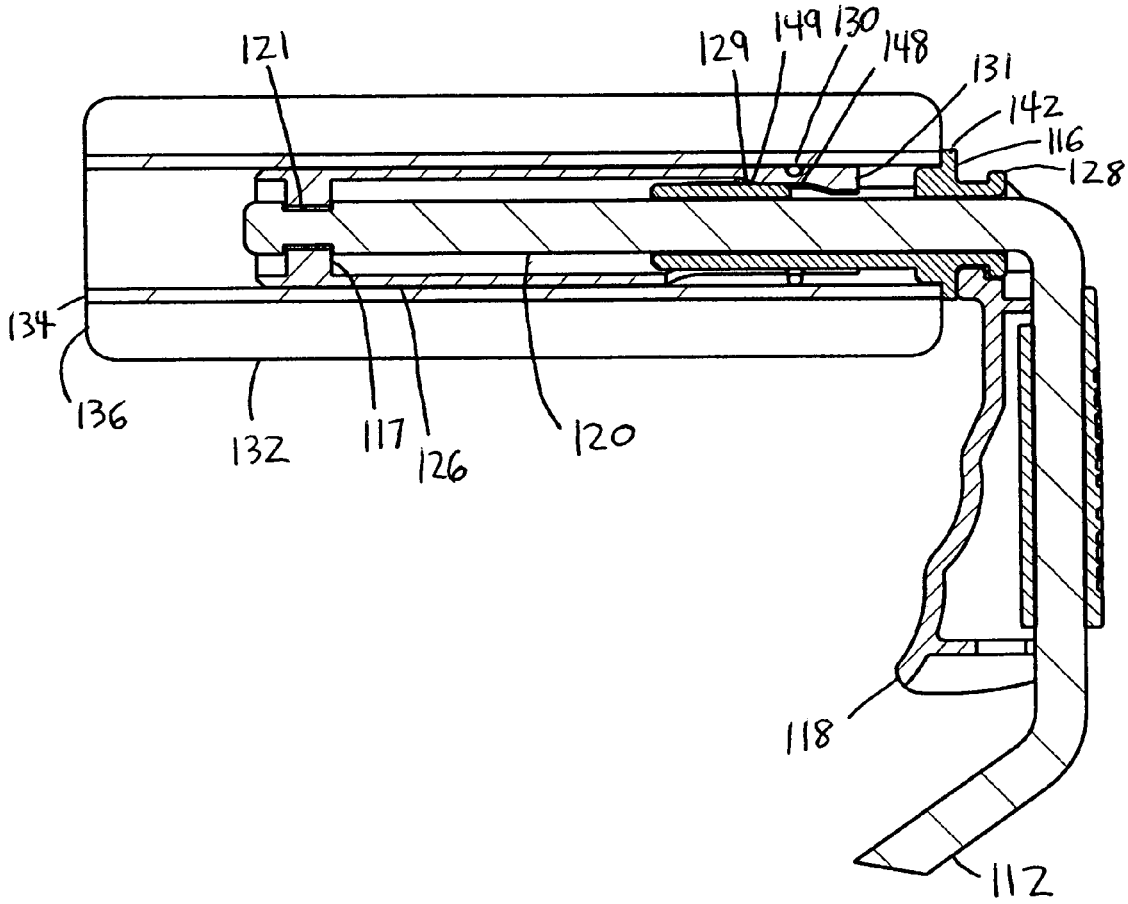
FIG. 7 is a detailed section view of an exemplary embodiment of a paint roller including a narrow diameter roller cover according to the present invention with the locking lever in the locked position.
Figure 8:
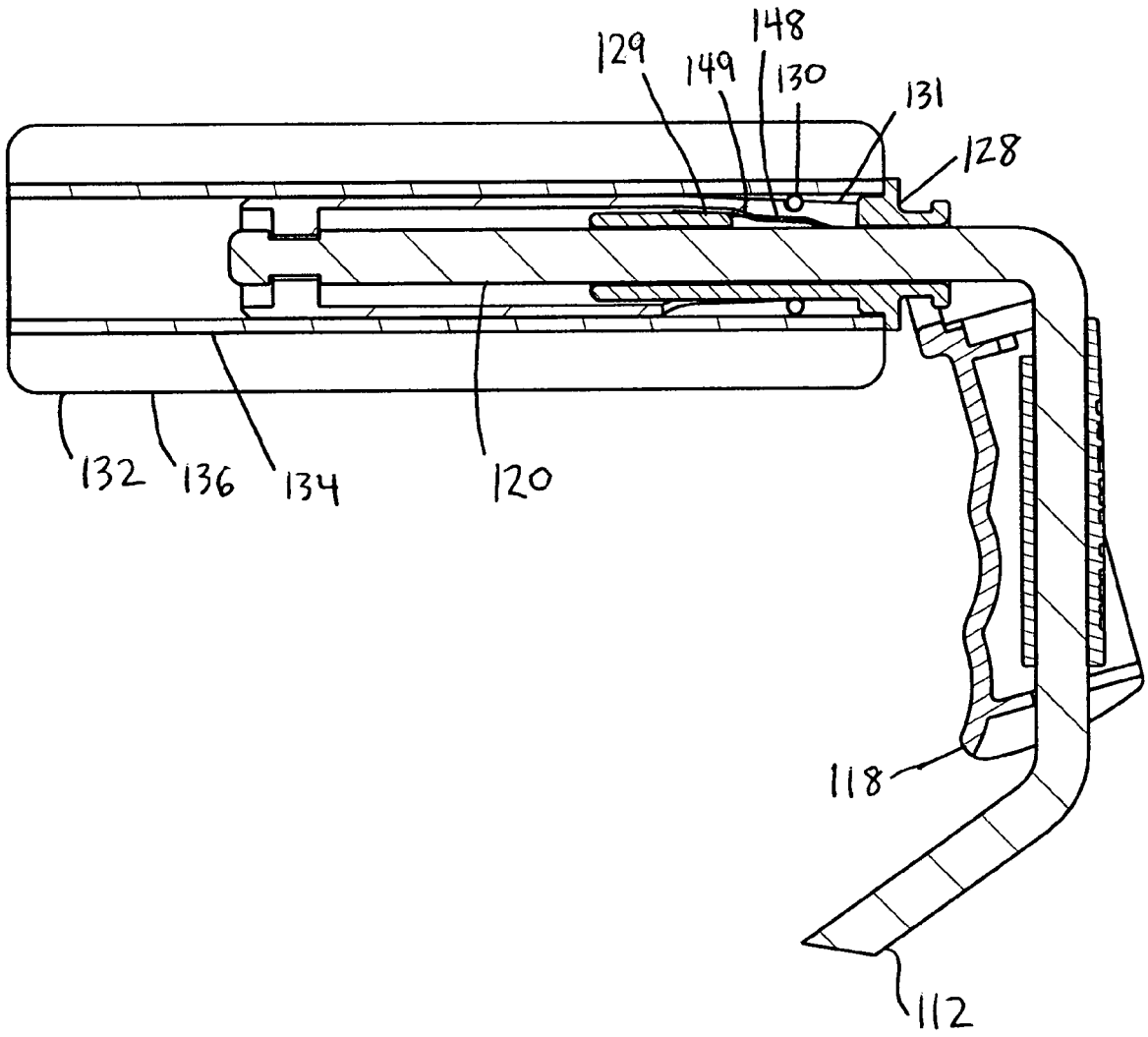
FIG. 8 is a detailed section view of an exemplary embodiment of a paint roller including a narrow diameter roller cover according to the present invention with the locking lever in the released position.

In the embodiment shown in FIGS. 6-8, the construction and operation of the paint roller 110 is similar to that described above with regard to FIGS. 1-5. The paint roller 110 includes a handle 114, a frame 112, a locking lever 118, and a pivot point 140. The roller cover 132 includes a rigid tube 134 and a nap portion 136. The roller assembly 116 includes a sliding hub 128, fixed hub 126 with fingers 131, and an o-ring 130. The sliding hub 128 includes surface 129 that slides along the fingers 131 on contact portions 148 and 149.

Figure 9:
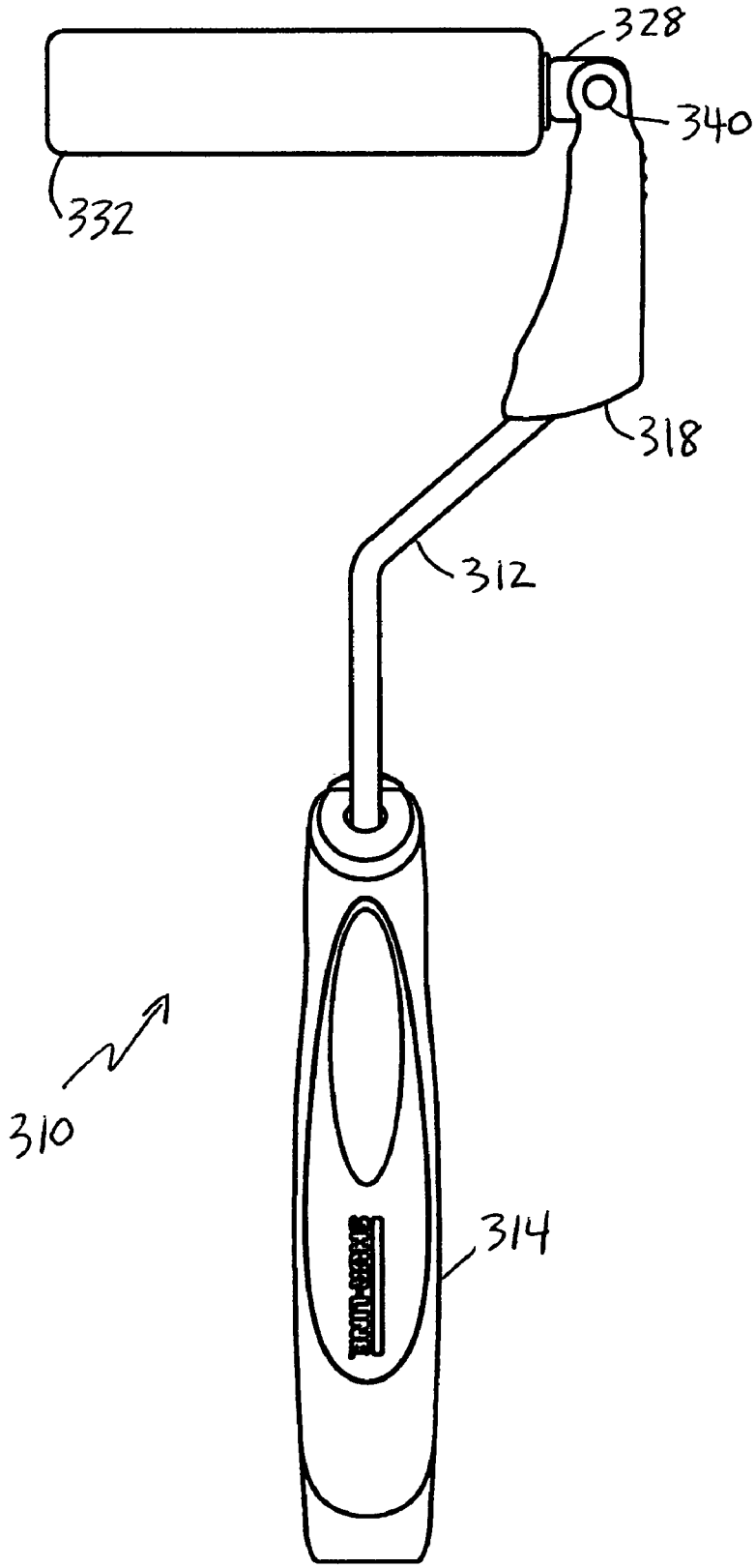
FIG. 9 is a front view of an alternative exemplary embodiment of a paint roller using a roller cover with an integral bearing.
Figure 10:
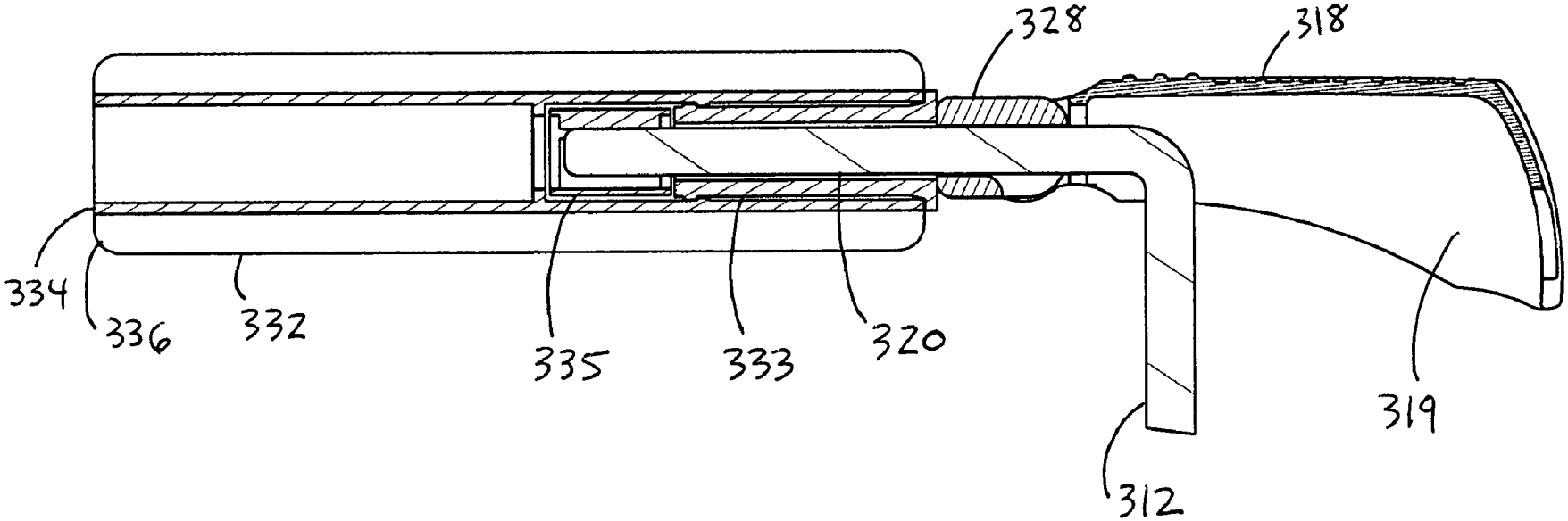
FIG. 10 is a detailed section view of the alternative exemplary embodiment of FIG. 9 with the locking lever in the unlocked position.
Figure 11:
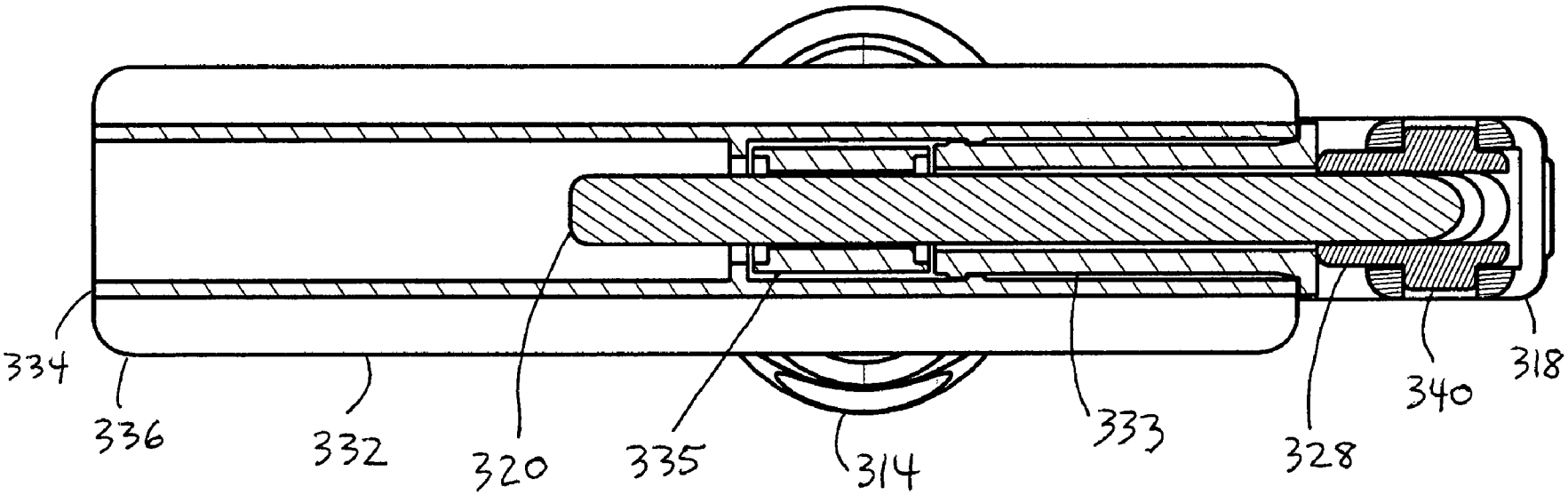
FIG. 11 is a detailed top section view of the alternative exemplary embodiment of FIG. 9.

FIGS. 9-11 depict an alternative embodiment of the present invention paint roller 310 designed to accommodate removable roller covers 332 having an integral bearing 333. This type of roller cover 332 typically includes a frictional retaining portion 335 adapted to frictionally engage the shaft 320 of the frame 312. The frictional retaining portion prevents the roller cover from sliding off of the shaft 320 during use. The bearing 333 is designed to allow free rotation of the outer portion of the roller cover 332, the nap 336 and the rigid tube 334, while leaving the frictional retaining portion 335 engaged with the shaft. The paint roller 310 includes a locking lever 318 pivotably attached to a sliding block. The sliding block 328 is slidable along the shaft 320.

This embodiment of the invention is operated as follows. The roller is ready to be used to apply paint when a roller cover 332 is installed and the locking lever 318 is in the locked position as shown in FIG. 9. To remove the roller cover 332, the user pivots the locking lever 318 to the unlocked position as shown in FIG. 10. The user preferably holds the paint roller 310 over an appropriate receptacle for a used roller cover which may be wet with paint. The user then pushes the locking lever 318 towards the terminal end of the shaft. Because the locking lever 318 and the sliding block 328 are attached at pivot point 340, the locking lever 318 causes the sliding block 328 to slide along the shaft 320 towards the terminal end. The sliding block 328 pushes on the bearing portion 333 of the roller cover 332, causing the roller cover 332 to slide off of the shaft 320. The total travel of the sliding block 328 is limited such that the sliding block 328 does not slide beyond the terminal end of the shaft 320. This limit is effected by the length of the hollow portion 319 of the locking lever. The user then returns the sliding block 328 and locking lever 318 to their initial positions. With the locking lever 318 in the locked position, the user is free to install a replacement roller cover 332 by sliding it onto the shaft 320.

In the above-described exemplary embodiments, the o-ring provides a mating component that is deformable such that it helps the paint roller accommodate variations on the inside diameter of a roller cover. Additionally, in the above-described exemplary embodiments, the o-ring biases the fingers radially inward such that the fingers move radially inward when the locking lever is moved to the unlocked position. It is within the scope of the invention replace or supplement the o-rings with one or more other components, such as, but not limited to, one or more springs and/or flexible protrusions which may be molded into the fixed hub.

It is also within the scope of the invention to mold one or more fingers of the fixed hub such that their natural state would be the retracted position. In such an embodiment, no additional component may be required to retract the fingers or to accommodate varying roller cover inside diameters. In such an embodiment, the natural state of the fingers may be approximately the position of finger 31 in FIG. 5 (or finger 131 in FIG. 8). With the locking lever 18 in the locked position, the fingers of such an embodiment may be held radially outward in approximately the position of finger 31 in FIG. 4 (or finger 131 in FIG. 7).

While preferred embodiments of the invention have been set forth above for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A paint roller comprising:
- a frame having an elongated portion, the elongated portion having a terminal end and a contiguous end; and
- a roller assembly rotatably coupled to the elongated portion of the frame and adapted to receive a removable paint roller cover, the roller assembly including
  - an axially movable portion,
  - a fixed portion including a plurality of fingers, the plurality of fingers extending generally parallel to the elongated portion of the frame, the plurality of fingers slidably engaging the axially movable portion such that axial motion of the axially movable portion causes the plurality of fingers to move radially relative to the elongated portion of the frame, and the plurality of fingers being contiguous with the fixed portion of the roller assembly, and
  - an elastic member extending around the plurality of fingers and holding the plurality of fingers in sliding engagement with the axially movable portion.

2. The paint roller of claim 1, further comprising a locking lever pivotably coupled to the frame and adapted to cause axial movement of the axially movable portion of the roller assembly when the locking lever is pivoted relative to the frame.

3. The paint roller of claim 2, wherein pivoting the locking lever to a locked position causes the plurality of fingers to move radially away from the elongated portion of the frame and pivoting the locking lever to a released position causes the plurality of fingers to move radially towards the elongated portion of the frame.

4. The paint roller of claim 3, wherein motion of the locking lever from the locked position to the released position causes the axially movable portion to move toward the terminal end and motion of the locking lever from the released position to the locked position causes the axially movable portion to move toward the contiguous end.

5. The paint roller of claim 4, wherein the thickness of the plurality of fingers varies along the length of each finger, the thickness increasing as a distance from the terminal end increases.

6. The paint roller of claim 5, wherein the axially movable portion includes a flange, the flange being adapted to push the roller cover at least partially off of the roller assembly when the locking lever is moved from the locked position to the released position.

7. The paint roller of claim 6, wherein the roller cover exerts a force on the flange generally parallel to the elongated portion of the frame and generally in the direction of the contiguous end as the roller cover is being installed, thus causing the locking lever to pivot from the released position to the locked position.

8. The paint roller of claim 7, wherein the elastic member is composed of rubber.

9. The paint roller of claim 8, wherein the elastic member is an o-ring.

10. A paint roller comprising:
- a frame having an elongated portion, the elongated portion having a terminal end and a contiguous end and
- a roller assembly rotatably coupled to the elongated portion of the frame and adapted to receive a removable paint roller cover, the roller assembly including
  - an axially movable portion,
  - a fixed portion including a plurality of fingers, the plurality of fingers extending generally parallel to the elongated portion of the frame, the plurality of fingers slidably engaging the axially movable portion such that axial motion of the axially movable portion causes the plurality of fingers move radially relative to the elongated portion of the frame, and the plurality of fingers being contiguous with the fixed portion of the roller assembly, and
  - an o-ring extending around the plurality of fingers and holding the plurality of fingers in sliding engagement with the axially movable portion.

11. The paint roller of claim 10, further comprising a locking lever pivotably coupled to the frame and adapted to cause axial movement of the axially movable portion of the roller assembly when the locking lever is pivoted relative to the frame.

12. The paint roller of claim 11, wherein the axially movable portion includes a flange, the flange being adapted to push the roller cover at least partially off of the roller assembly when the locking lever is moved from a locked position to a released position.

13. The paint roller of claim 12, wherein the roller cover exerts a force on the flange generally parallel to the elongated portion of the frame and generally in the direction of the contiguous end as the roller cover is being installed, thus causing the locking lever to pivot from the released position to the locked position.

14. The paint roller of claim 13, wherein pivoting the locking lever to the locked position causes the plurality of fingers to move radially away from the elongated portion of the frame and pivoting the locking lever to the released position causes the plurality of fingers to move radially towards the elongated portion of the frame.

15. The paint roller of claim 14, wherein motion of the locking lever from the locked position to the released position causes the axially movable portion to move toward the terminal end and motion of the locking lever from the released position to the locked position causes the axially movable portion to move toward the contiguous end.

16. The paint roller of claim 15, wherein the thickness of the plurality of fingers varies along the length of each finger, the thickness increasing as a distance from the terminal end increases.

17. A paint roller comprising:

a frame having an elongated portion, the elongated portion having a terminal end and a contiguous end; and a roller assembly rotatably coupled to the elongated portion of the frame and adapted to receive a removable paint roller cover, the roller assembly including an axially movable portion, and a fixed portion including a plurality of fingers, the plurality of fingers slidably engaging the axially movable portion such that axial motion of the axially movable portion in a first direction causes the plurality of fingers to elastically deform radially away from the elongated portion of the frame and axial motion of the axially movable portion in a second direction, the second direction being opposite the first direction, allows the plurality of fingers to return to a less elastically-deformed position thereby moving radially towards the elongated portion further comprising a locking lever pivotably coupled to the frame and adapted to cause axial movement of the axially movable portion of the roller assembly when the locking lever is pivoted relative to the frame.

18. The paint roller of claim 17, wherein the axially movable portion includes a flange, the flange being adapted to push the roller cover at least partially off of the roller assembly when the locking lever is moved from a locked position to a released position.

* * * * *